US005128072A

United States Patent [19]

Schydlo

[11] Patent Number: 5,128,072

[45] Date of Patent: Jul. 7, 1992

[54] FLUID-JET GENERATOR FOR A LIQUID RECEPTACLE

[76] Inventor: Martin T. Schydlo, An den Dieken 61, D-4030 Ratingen, Fed. Rep. of Germany

[21] Appl. No.: 631,693

[22] Filed: Dec. 18, 1990

[30] Foreign Application Priority Data

Dec. 19, 1989 [DE] Fed. Rep. of Germany ..... 3941819

[51] Int. Cl.[5] ..... B01F 3/04

[52] U.S. Cl. ..... 261/64.1; 261/124; 4/453

[58] Field of Search ..... 261/124, 64.1; 4/453, 4/196; 128/66

[56] References Cited

U.S. PATENT DOCUMENTS

| | | | |
|---|---|---|---|
| 1,034,919 | 8/1912 | Leuschner | 4/543 |
| 1,144,940 | 6/1915 | Lamb et al. | 261/124 |
| 1,201,395 | 10/1916 | Vissering | 261/124 |
| 1,796,759 | 3/1931 | Martocello | 261/124 |
| 2,771,320 | 11/1956 | Korwin | 261/124 |
| 3,043,296 | 7/1962 | Gregory | 128/66 |
| 3,080,124 | 3/1963 | Rathmann | 261/124 |
| 3,251,071 | 5/1966 | Wood | 4/543 |
| 3,525,685 | 8/1970 | Edwards | 261/124 |
| 3,651,646 | 2/1972 | Grunau | 261/124 |
| 3,849,059 | 11/1974 | Filippov et al. | 261/124 |
| 4,207,877 | 6/1980 | Marquardt | 128/66 |
| 4,269,797 | 5/1981 | Mikiya et al. | 261/DIG. 88 |
| 4,581,137 | 4/1986 | Edwards | 261/124 |
| 4,960,546 | 10/1990 | Tharp | 261/124 |

FOREIGN PATENT DOCUMENTS 2114534 6/1972 Fed. Rep. of Germany .

*Primary Examiner*—Tim Miles

*Attorney, Agent, or Firm*—Herbert Dubno

[57] ABSTRACT

Fluid jets are generated in liquid in a receptacle utilizing a hollow flexible strip or bar provided with a snap, clamp or plug release connection at at least one end engaging the pipe end of a fitting having at least one right angle and provided with a stub which passes through a wall in a receptacle against which the fitting is sealed by a nut. The bar has a flattened configuration and an elongated oval cross section and is held by an adhesive strip or suction cups against the inner surface of the receptacle wall.

17 Claims, 2 Drawing Sheets

FLUID-JET GENERATOR FOR A LIQUID RECEPTACLE

FIELD OF THE INVENTION

My present invention relates to a fluid-jet generator for a liquid receptacle and, more particularly, an inlet device for producing fluid jets in a liquid contained in a receptacle, especially jets of water and/or air or water-air mixtures in a liquid such as water. The invention, more specifically, relates to a jet-producing device of the afore-described type which has a hollow bar along which a multiplicity of outlet orifices for the fluid are provided, which lies along a inner wall of the receptacle and which is fed by a pump through a pipe connection extending outwardly from the receptacle.

BACKGROUND OF THE INVENTION

Liquid receptacles such as fish ponds, water-storage reservoirs, tanks and other facilities containing water or aqueous systems may be aerated or agitated by the injection of air or water or an air-water mixture into the liquid within the receptacle. Generally speaking, the pipe system for supplying the fluid and distributing the liquid in the receptacle is a bulky and complex arrangement. Where air and water are to be injected together or through respective nozzles, connections are required for both the air and the water by appropriate fittings which can be connected by hoses, pipes or the like to the air or water sources. The nozzle systems within the receptacle are frequently inaccessible and, in many cases, cannot be changed, replaced or even cleaned with any degree of regularity. Sealing problems arise when the systems must be disassembled for cleaning.

In prior art systems, the nozzles can be inserted from the interior of the receptacle and clamped from the outer side so that for the nozzles respective bores must be provided in the wall of the receptacle and these bores must be sealed.

On the outer side of the receptacle, a T fitting can be mounted, whose shank can be connected to the nozzle and whose cross bar can be connected to the cross bars of other nozzles by appropriate piping and to the source of the fluid to be injected.

Because of the many holes required in the wall and the individual mounting of the nozzles forming the respective orifices, the apparatus is expensive. Because of the need to mount numerous small parts, the mounting operation is time consuming and complex. At each mounting location there is a danger that the seal may be lost because of fluctuations in temperature and varying mechanical stresses and loads which may be applied to the parts. Because of the spatial requirements for the feed and connecting pipelines, the piping must have a relatively small cross section so that the piping is characterized by high flow losses, comparatively noisy operations and limited versatility. For example, if hot water is to be injected, the hot water suffers a substantially greater cooling in piping of small cross section than in piping of larger cross section.

For jet generators which are intended for use in whirlpool baths and the like, there is also a problem of hygiene, especially in the region of the nozzles. In the use of liquid receptacles and especially whirlpool baths, it generally cannot be avoided that contaminants and bacteria collect in the piping systems and create hygiene problems within the receptacle. The earlier systems cannot be readily disassembled for cleaning and if they can be disassembled, cannot be reassembled without the danger of seal deterioration.

German Patent Document DE-A-21 14 534 describes a grate for the finely divided introduction of gases into a bath liquid in a bubbling mode. The bubbling grate comprises grate bars of yieldable material, for example, a plastic synthetic resin, which constitutes the gas distribution system. The method of connection of this grate to the gas source, for example, a pump, is not detailed there.

OBJECTS OF THE INVENTION

It is, therefore, the principal object of the present invention to provide an improved inlet device for the injection of jets of a fluid into a body of fluid in a receptacle whereby drawbacks of earlier systems are avoided Another object of this invention is to provide a device for generating jets of a fluid in a liquid having simplified construction of the nozzles and the connecting fittings therefor which will allow the system to be modified for varying applications.

Still another object of this invention is to provide a system in which the nozzle arrangement can be readily cleaned.

SUMMARY OF THE INVENTION

These objects and others which will become more readily apparent hereinafter are attained, in accordance with the invention, in a device for generating fluid jets in a liquid in a receptacle having an opening in a wall thereof, preferably at the bottom of the receptacle, and in which a fitting is received in the form of an angle pipe having a pipe end in the receptacle whose axis lies generally parallel to the receptacle wall. An elongated hollow bar is connected to this end by a snap, clamp or plug connector in a releasable manner.

The nozzle bar can be a flexible bar with a multiplicity of outlet orifices by contrast with the rigid nozzles and bubblers hitherto employed, and the bar can be applied generally flat against the wall of the receptacle, for example, a whirlpool bath and oriented in any desired manner as the bar radiates from the fitting.

The releasable or disconnectable-connection of the bar end in the region of the wall opening permits removal of the hollow bar for cleaning and/or disinfection.

According to the invention, therefore, the device for generating fluid jets in a liquid comprises:

- an inlet fitting extending through a wall of a receptacle containing a liquid and of a configuration of an angled pipe with an end having an outlet with an axis generally parallel to the wall;
- a hollow bar extending parallel to the wall and formed with a multiplicity of outlet orifices distributed over a length of the bar for discharging fluid jets into the liquid, the hollow bar having at least one connection end; and
- releasable connector means detachably connecting the ends to effect communication between the fitting and the hollow bar to enable the fluid to be fed from the fitting to the hollow bar.

According to a further feature of the invention, the fitting is a 90° elbow, a T fitting or a cruciform fitting with a stub extending through the opening of the wall. Depending upon the number of pipe ends the fitting has within the receptacle, a corresponding number of hollow bars may be attached to the fitting. Advantageously, the flexible hollow bars are elongated oval cross section and have flat bottoms or bottom surfaces which are planar so that in use they are free from ribs or other projections holding the hollow bar away from the receptacle bottom or wall.

To prevent shifting of the hollow bar in use in spite of its flexibility, the substantial planar bottom surfaces can be formed with suction cups or a flexible adhesive layer which can frictionally or adhesively engage the container bottom or wall but can be released therefrom.

The outlet orifices (nozzle orifices), according to a further feature of the invention are provided on the upper side of the bar, preferably along the middle thereof and can . be equidistant from one another to provide a maximally uniform distribution of the air or water which is discharged or a uniform pressure distribution within the hollow bar.

According to a further feature of the invention, the hollow bar itself is formed from a plurality of bar segments by detachable plug connections.

If the hollow bar is connected to fittings at both of its ends through which, for example, air is forced into the hollow bar, the air pressure required for forming the jets can be readily built up to counter the hydrostatic pressure in the receptacle and can be relatively uniform.

To avoid the presence within the receptacle interior of edges which might be annoying or harmful, the fitting ends and the connecting region with the hollow bar can be covered by a cap. This cap also protects the releasable connector means between the hollow bar and the fitting against undesired release. The cap can engage over the fitting from the releasable connector and extend to the inner wall of the receptacle, the cap being flush with the other parts of the system or imparting a shape to the fitting region which is harmonious with the shape of the bar.

The cap, which can be formed as part of the fitting or simply applied thereto, can have, preferably in the region of the inner wall of the receptacle, one or more outlet orifices from which jets of water or air emerge.

Advantageously, the angle pipe or fitting, the cap and/or the hollow bar are composed of a plastic With appropriate selection of the plastic or synthetic resin which is used, sealing problems can largely be avoided. These parts can advantageously be fabricated by low-cost injection molding.

The connection between two hollow bars and/or between the hollow bar and the pipe end of the fitting can advantageously be a simple plug connection with one of the ends being formed with a circumferential bead with a corresponding groove to constitute a detachable snap connector with the bead. The stub of the fitting passing through the opening in the wall can be threaded to accommodate a nut, preferably also composed of a plastic which clamps the fitting against the receptacle wall. To prevent water from the receptacle from passing back through the fitting, the stub transferring the opening in the wall can have a checkvalve built into it. It is also possible, in accordance with the invention to provide a valve in this stub which can be regulated to control the pressure which is developed in the hollow bar.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
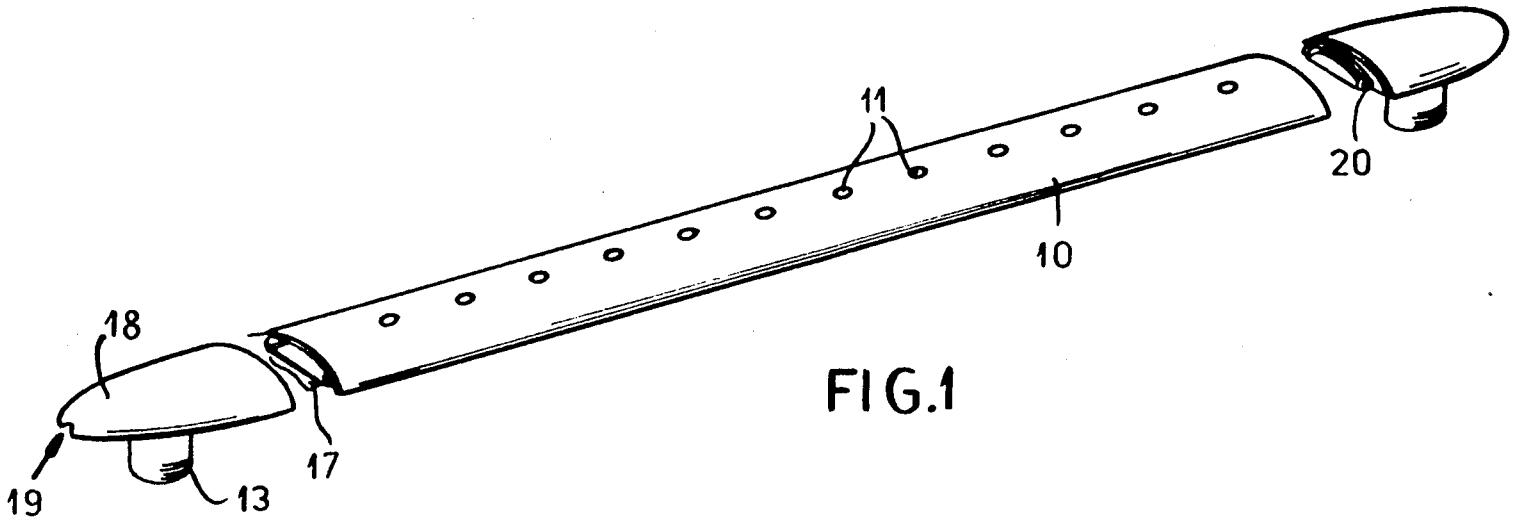
FIG. 1 is a perspective view of a hollow bar shown in partly exploded form and in association with capped fittings at the ends thereof.

The hollow bar 10 illustrated in the drawing is formed along the upper side in a longitudinal medium plane of the bar with a row of equispaced outlet openings 10 and rests upon the bottom 12 of the receptacle containing a body of fluid into which jets from the orifices 11 are to be injected. The receptacle 12 may be a whirlpool bath.

The hollow bar has a flat cross section and may lie flat except when a fluid under pressure is supplied thereto. It is of elongated oval cross section when fluid pressure is supplied, and has a flat bottom and an upper part which is convexly curved in cross section To prevent the hollow bar 10 from shifting on the surface 12*a* of the receptacle bottom 12, the bottom of the bar is formed with an adhesion layer 17 of flexible elastic material which frictionally adheres to the surface 12*a*. As can be seen from FIG. 3, however, the bottom of the hollow bar 10 may also be formed with suction cups or suction projections 17*a* which can adhere releasably to the surface 12*a*. When the member 17*a* or the strip 17 is pressed against the surface 12*a* to expel air therefrom, a suction is generated to insure adhesion of the hollow strip 10 to the surface 12*a*.

The wall 12 is formed with an opening 12*b* through which the stub 13*c* of a T fitting 13 passes. This stub is extendedly threaded at 13*a* and forms a thread connection 13*a*, 14*a* with a nut 14 to clamp the fitting via a rubber washer 15 against the wall 12 of the receptacle and thereby seal the fitting thereagainst.

Figure 2:
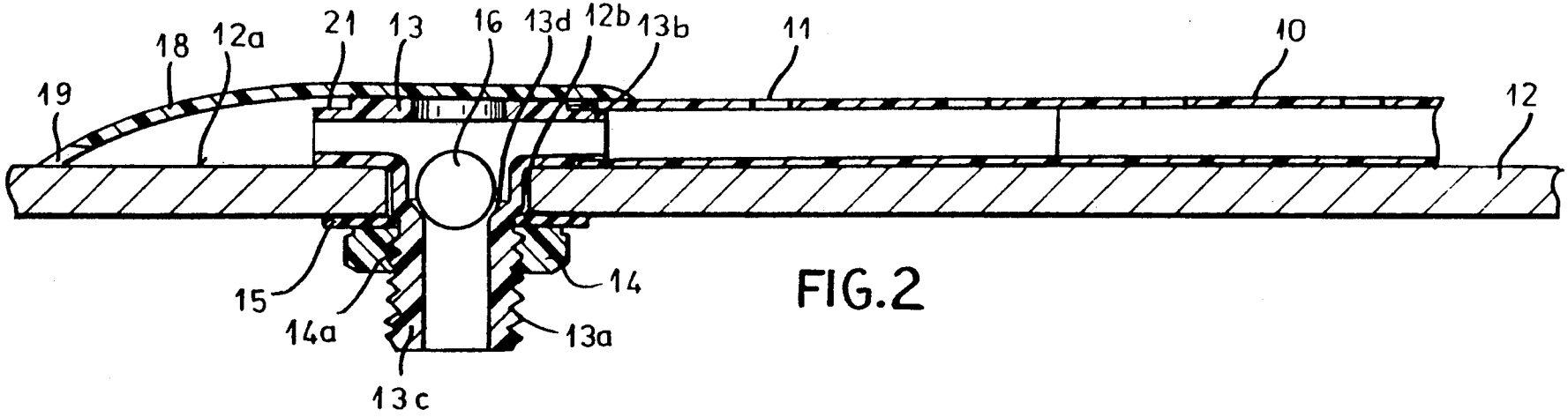
FIG. 2 is a longitudinal section through one of the fittings and the bar plugged onto it.

The T 13 fitting contains a check valve which can be seen in FIG. 2 to be constituted by a ball 16 engaging a seat 13*d* of the fitting.

Figure 5:
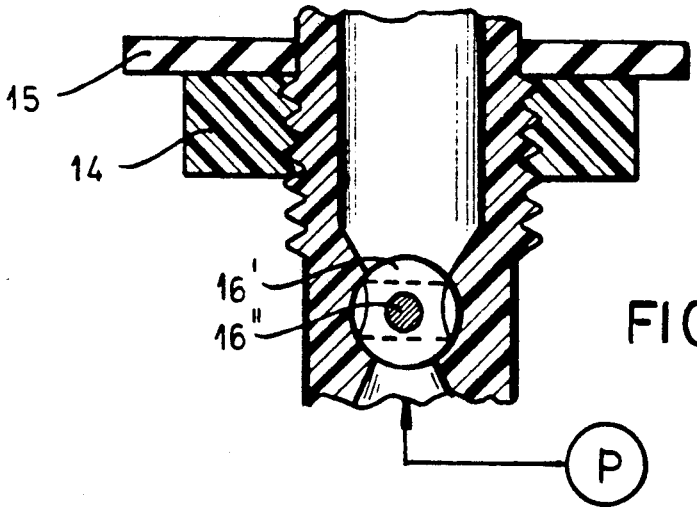
FIG. 5 is a cross sectional view through the stub of a fitting provided with a control valve according to the invention.

Alternatively, a controllable valve 16' which is rotatable by a stem 16" (perpendicular to the plane of the paper in FIG. 5) may be used. In this case the valve controls the pressure in the hollow strip 10.

Figure 3:
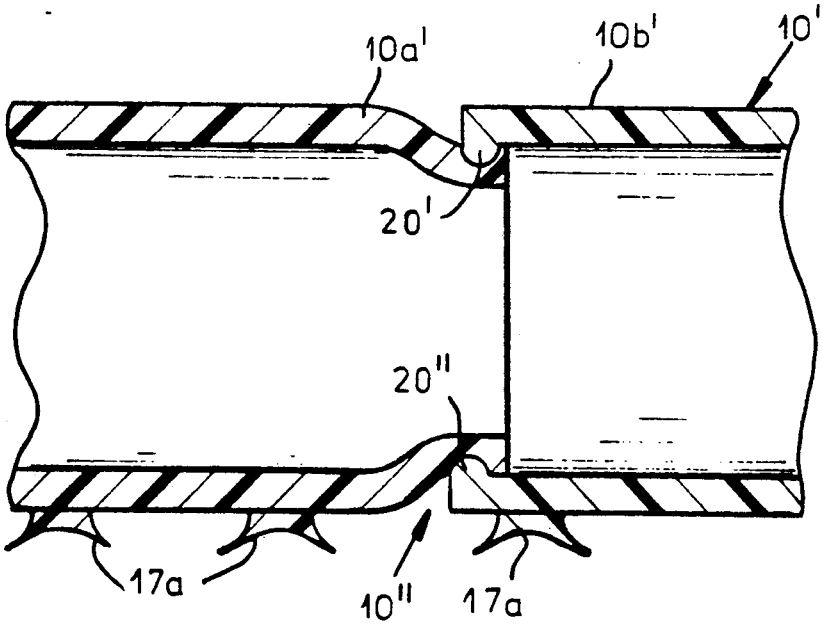
FIG. 3 is a detailed view illustrating a plug type connection which can be used to connect segments of the bar or to connect the bar to the fitting.

The pipe end 13*b* (FIG. 2) which extends parallel to the surface 12*a*, is releasably connected with the hollow strip or bar 10. The releasable connecting means between the end 13*b* and the end of the bar 10 can include an annular recess 21. This forms a plug connection, i.e. a formation over which the bar 10 can be plugged. The connection can also include a snap connection as illustrated in FIG. 3. The bead 20 shows a snap connection for the fitting on the opposite side of FIG. 1, this groove in the hollow bar.

From FIG. 3 it can be seen that the hollow bar 10' may be assembled from segments 10*a'* and 10*b'* utilizing a similar snap connected represented at 10". In this case, the snap connection is formed by a bead 20' engageable in a groove 20". A similar snap connection can be used between the fitting end and the hollow bar 10.

The T fitting 13 is covered by a cap 18 which extends from the releasable connecting means attaching the bar 10 to the fitting 13 to the surface 12*a* and rests against the surface 12*a*. The cap 18 thus covers the junction of the bar 10 with the fitting and any edges of the fitting and the bar in this region and provides a smooth surface. The cap can, in addition, have one or more outlet orifices 19, preferably close to the surface 12*a*.

The mounting of the device and the detachment of the hollow bar can be effected in a simple manner. For example, the hard PVC T fitting 13 can be inserted from the interior and clamped in place by the nut 14. The hollow bar 10 is then connected to the pipe end 13*b* by the snap connection previously described and the cap 18 can then be applied.

When it is necessary to remove the bar 10 for cleaning, it is simply unsnapped from the fitting. Because of the flexibility of the bar 10 it can also be unsnapped from both pipe ends 13*b* when two fittings are used to hold the bar 10 at opposite ends.

A plurality of bars may be connected together in the manner described by forming one end of a hollow bar with a male formation and the other end with a female plug formation, the pipe ends of the fittings being configured complementarily to mate with the male and female ends respectively.

In principle, it is also possible to provide the cap on its open side as its sleeve which has the same cross sections as the pipe end 13*b* and the hollow bar 10 and into which the hollow bar 13*b* and the pipe 10 can be shoved.

The invention has the significant advantage over prior art systems that flexible hollow bars can be placed along desired lines in the whirlpool bath with the outlet orifices 11 oriented at will with simplicity. This is especially the case when the bar 10 is connected only at one end to a fitting. The removal of the hollow bar, for example, for cleaning, requires only disconnection at the pipe end 13*b*.

Figure 4:
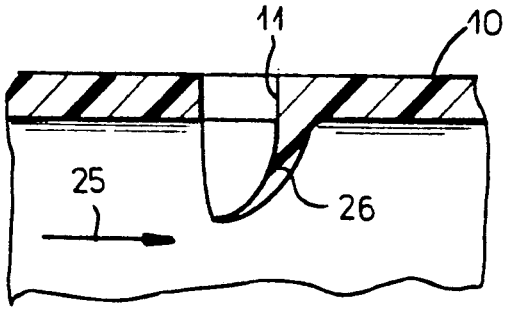
FIG. 4 is a cross sectional view of a guide vane arrangement disposed in the vicinity of an orifice of the hollow bar.

As can be seen from FIG. 4, in the path of the fluid through the bar 10 (arrow 25), guide vanes 26 can extend from the inner wall of the hollow bar 10 inwardly behind each orifice 11 to insure uniform distribution of the fluid to the receptacle along the length of the bar.

The nozzle arrangement of the invention can also be used in other tanks, reservoir or container arrangements, including aquariums, fish ponds, swimming pools or the like.

I claim:

1. A device for generating fluid jets in a liquid in a receptacle, comprising:

an inlet fitting extending through a wall of a receptacle containing a liquid and of a configuration of an angled pipe with an end having an outlet with an axis generally parallel to said wall;

a hollow bar extending parallel to said wall and formed with a multiplicity of outlet orifices distributed over a length of said bar for discharging fluid jets into said liquid, said hollow bar having at least one connection end; and releasable connector means detachably connecting said ends to effect communication between said fitting and said hollow bar to enable said fluid to be fed from said fitting to said hollow bar, said fitting being formed as an elbow, cruciform or T-shaped member having a connecting stub extending through said wall and at least one outlet end at a right-angle to said stub and formed with part of said releasable connector means, said hollow bar being generally flexible, being of flattened oval cross section, and having a planar bottom lying generally against said wall.

2. The device defined in claim 1 wherein said releasable connector means forms a snap connector affixing said bar on said fitting.

3. The device defined in claim 1 wherein said releasable connector means forms a plug connector affixing said bar on said fitting.

4. The device defined in claim 1 wherein said releasable connector means includes a plug connection between said ends with one of said ends being formed with a groove and the other of said ends being formed with a rib forming a detachable snap connector with said groove.

5. The device defined in claim 1 wherein said stub is threaded, said device further comprising a nut threaded onto said stub and clamping said stub against said wall.

6. The device defined in claim 1, further comprising a checkvalve in said fitting.

7. The device defined in claim 1, further comprising a controllable valve in said fitting.

8. The device defined in claim 1 wherein said planar bottom is formed with a flexible adhesive layer lying against said wall.

9. The device defined in claim 1 wherein said orifices are formed substantially along a longitudinal median plane through said bar on an upper side thereof.

10. The device defined in claim 1, further comprising guide vanes on an inner wall of said bar extending into an interior thereof behind each of said orifices in a direction of feed of said fluid through said bar.

11. The device defined in claim 1 wherein said bar is assembled from a plurality of bar segments interconnected by detachable plug connections.

12. The device defined in claim 1 wherein each of two opposite ends of said bar are engaged through releasable connectors with respective fittings mounted on said wall.

13. The device defined in claim 1, further comprising a cap fitting over said ends and said fitting in said receptacle.

14. The device defined in claim 13 wherein said wall is a receptacle bottom and is formed with a passage through which said fitting extends, said fitting, said cap and said bar being composed of injection-molded plastic.

15. The device defined in claim 13 wherein said cap is connected to said fitting or is formed as part of said fitting.

16. The device defined in claim 13 wherein said cap lies outwardly of said releasable connector means and extends from said releasable connector means to said wall.

17. The device defined in claim 16 wherein said cap is provided with at least one outlet orifice opening into said receptacle close to said wall.

* * * * *